US005965982A

United States Patent [19]

Tachino et al.

[11] Patent Number: 5,965,982

[45] Date of Patent: Oct. 12, 1999

[54] SIDE-ON TYPE PHOTOMULTIPLIER

[75] Inventors: Masumi Tachino; Hidehiro Kume; Suenori Kimura; Takashi Goto, all of Hamamatsu, Japan

[73] Assignee: Hamamatsu Photonics K.K., Shizuoka-ken, Japan

[21] Appl. No.: 08/924,141

[22] Filed: Sep. 5, 1997

[30] Foreign Application Priority Data

Sep. 6, 1996 [JP] Japan ..... 8-237022

[51] Int. Cl.[6] ..... H01J 43/04

[52] U.S. Cl. ..... 313/532; 313/524; 313/533; 313/525; 250/207

[58] Field of Search ..... 313/524, 532, 313/533, 535, 544, 539

[56] References Cited

U.S. PATENT DOCUMENTS

| | | | |
|---|---|---|---|
| 3,028,288 | 4/1962 | McKeirnan et al. | 313/524 |
| 3,457,447 | 7/1969 | Menelly et al. | 313/524 |
| 3,567,948 | 3/1971 | Oke | 250/216 |
| 5,023,511 | 6/1991 | Phillips | 313/524 |
| 5,847,380 | 12/1998 | Tachino et al. | 313/524 |

FOREIGN PATENT DOCUMENTS

| | | |
|---|---|---|
| 2-22334 | 5/1990 | Japan . |
| 6-11572 | 1/1994 | Japan . |
| 6-109635 | 4/1994 | Japan . |

*Primary Examiner*—Ashok Patel
*Attorney, Agent, or Firm*—Pillsbury Madison & Sutro LLP

[57] ABSTRACT

The present invention relates to a versatile side-on type photomultiplier comprising a structure for improving the uniformity in light receiving sensitivity. Disposed on the outer peripheral surface of a sealed envelope of this photomultiplier is a restricting member which guides light to be detected into, of the light receiving surface of a photocathode, an effective region where the light receiving sensitivity is high, thereby restraining the light to be detected from reaching the outside of the effective region.

5 Claims, 7 Drawing Sheets

SIDE-ON TYPE PHOTOMULTIPLIER

BACKGROUND OF THE INVENTION

1. Field of the Invention

The present invention relates to a light detecting apparatus for detecting light incident thereon and, in particular, side-on type photomultiplier having a photocathode which is inclined with respect to the direction of incidence of the light.

2. Related Background Art

For instance, Japanese Patent Publication No. 2-22334 discloses an example of side-on type photomultipliers. In the photomultiplier disclosed in this publication, light passing through a slit is guided through an imaging lens onto a reflection type photocathode. Such a configuration shortens the electron transit time between the photocathode and the dynode of the first stage, thereby reducing the fluctuation in electron transit time.

SUMMARY OF THE INVENTION

Having studied the conventional side-on type photomultiplier having the above-mentioned configuration, the inventors have found the following problems. Namely, in the conventional photomultiplier, because the imaging lens is seperate from the photomultiplier, it is necessary for the imaging lens and the photocathode to be precisely aligned, in terms of optical axis, with respect to the light to be detected. In particular, this optical axis alignment is necessary after an operation for whenever replacing the photomultiplier. Also, an additional apparatus is necessary to alian the optical axis of the imaging lens with the photocathode, thus affecting usability. Further, because the slit eliminates a part of light which should reach the photocathode, the conventional photomultiplier may not be suitable for use as a measuring device of weak light, thus lacking in versatility (restricting its use).

In order to overcome the above-mentioned problems, it is an objective of the present invention to provide a side-on type photomultiplier which produces excellent versatility and improves the uniformity of its light receiving sensitivity.

The side-on type photomultiplier, according to the present invention, guides light to be detected into a reflection type photocathode located within a sealed envelope, cascade-multiplies by an electron multiplier comprising a plurality of stages of dynodes, photoelectrons emitted from the reflection type photocathode, and collects the multiplied secondary electrons at an anode as output electric signals. Specifically, the side-on type photomultiplier, according to the present invention comprises, at least, which is an envelope, a photocathode, a restricting member, and an adhesive. The envelope is made of a material transparent to light which is to be detected. The photocathode, which has a light receiving surface with a predetermined area, emits photoelectrons in response to the light to be detected transmitted through the envelope. The restricting member limits the area of a light incident region on the photocathode, where the light to be detected reaches, so as to make it smaller than the area of the light receiving surface of the photocathode. The adhesive, provided between the restricting member and the outer peripheral surface of the envelope, secures the restricting member onto the outer peripheral surface of the envelope.

Here, the photomultiplier is a side-on type in which light to be detected is made incident thereon from a side face of the envelope. In contrast, the above-mentioned photocathode is a reflection type photocathode which is supported by an electrode member while being inclined with respect to the direction of incidence of the light to be detected. This reflection type photocathode emits photoelectrons in a direction opposite to the advancing direction of the light to be detected. Preferably, the above-mentioned restricting member and adhesive are made of materials transparent to the light to be detected.

In particular, a condenser lens, (lens element) having a positive refracting power, can be employed as the above-mentioned restricting member. In order to improve the contact between the condenser lens and the envelope and reduce the optical coupling loss therebetween, the condenser lens has a bonding surface (concave surface) having a shape matching that of the outer peripheral surface (convex surface) of the envelope. Further, since this condenser lens is attached beforehand to the envelope of the photomultiplier by the adhesive provided therebetween, neither operation nor apparatus for effecting the optical axis alignment of the condenser lens is necessary.

Preferably, the condenser lens includes a cylindrical lens having a bonding surface with a shape substantially identical to that of the light incident region (on the outer peripheral surface) of the envelope, and a cylindrically-curved light entrance surface facing the bonding surface. When such a cylindrical lens is employed, the light to be detected can be collected, in a slit form, within the effective region on the photocathode and thus, elongating the form of the collected light on the photocathode in its longitudinal direction so as to match the long form of the photocathode. Accordingly, the form of the area of the photocathode 9 on which the collected light reaches can match the long form of the dynode in each stage, thus allowing the electron multiplying region of each dynode to be utilized efficiently. Also, it becomes unnecessary to perform an operation for inserting a slit plate between an object to be measured and the photomultiplier, and the axial alignment of the slit in the slit plate with the photocathode. Here, "cylindrical lens" refers to a lens having at least one surface formed like a part of a cylinder and yielding astigmatism such that a point of light extends into a line.

Also, the above-mentioned condenser lens may include a hemispherical lens having a bonding surface with a shape substantially identical to the outer peripheral surface of the envelope and a spherically-curved light entrance surface. Since the light to be detected can be collected onto the photocathode in a spot form, such an arrangement is effective particulary for detecting weak light.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

In the following, preferred embodiments of the side-on type photomultiplier according to the present invention will be explained in detail with reference to FIGS. 1 to 9.

Figure 1:
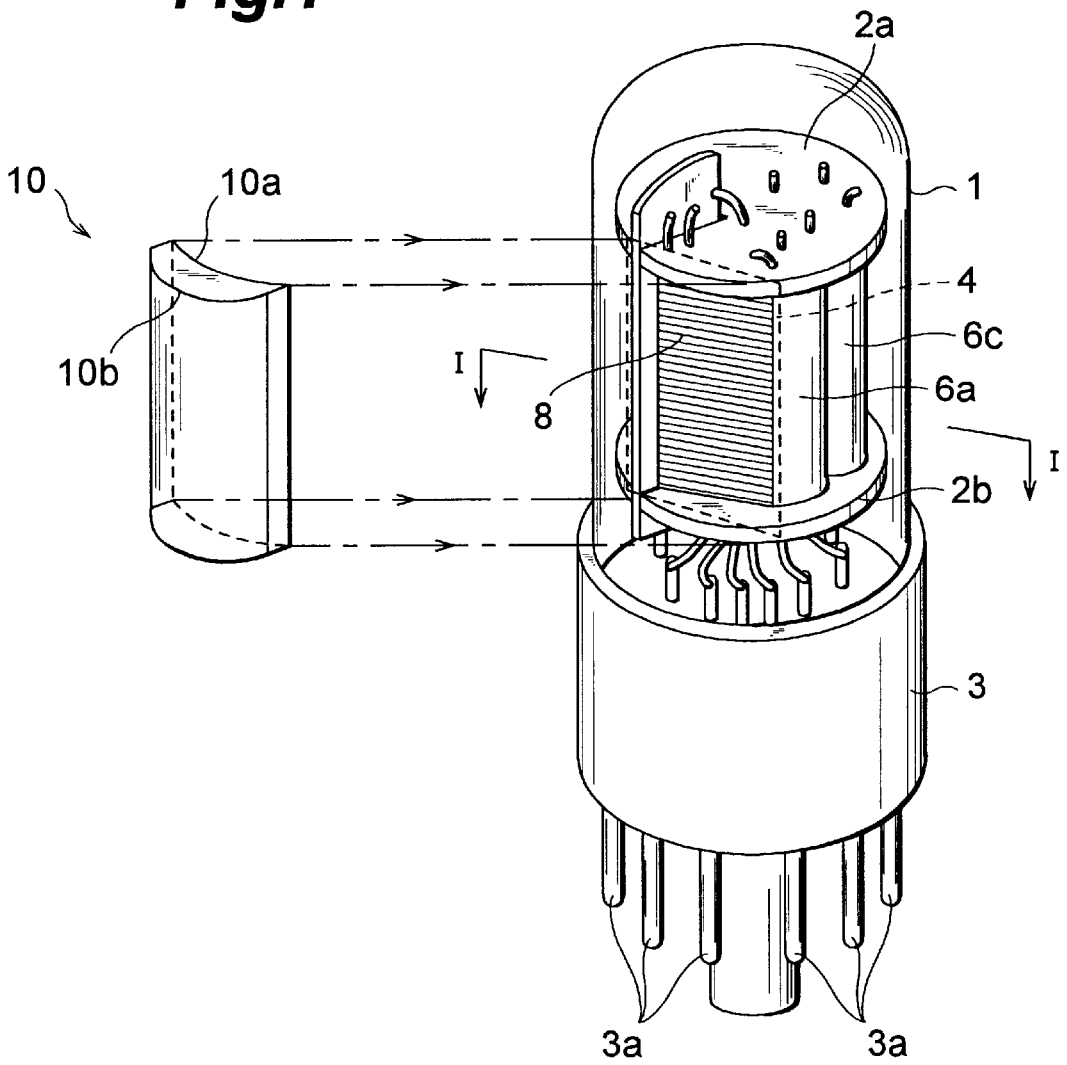
FIG. 1 is a perspective view for explaining an assembling step of a first embodiment of the side-on type photomultiplier according to the present invention.
Figure 2:
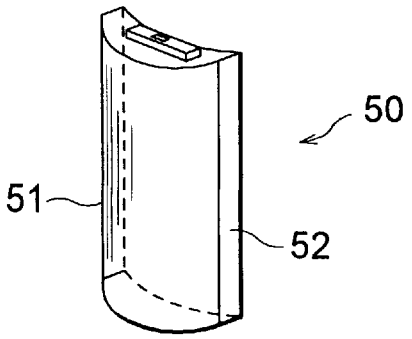
FIG. 2 is a perspective view showing a structure of a lens element (restricting member) made of a plastic material, which is applicable to the side-on type photomultiplier shown in FIG. 1.

FIG. 1 is a perspective view for explaining an assembling step of a first embodiment of the side-on type photomultiplier according to the present invention. In this drawing, the side-on type photomultiplier includes a sealed envelope 1 transparent to light to be detected. This sealed envelope 1 is formed as a transparent cylinder whose upper and lower ends are closed, while comprising borosilicate glass, UV glass, silica glass, or the like. In the sealed envelope 1, insulator substrates 2*a* and 2*b* made of ceramics or the like are respectively disposed at upper and lower portions thereof, such that various kinds of electrodes are supported as being held between a pair of the insulator substrates 2*a* and 2*b*. Secured to the bottom portion of the sealed envelope 1 is a pin base 3 made of a resin. This pin base 3 is provided with a plurality of pin terminals 3*a*, by which the various kinds of electrodes are lead to the outside.

Figure 3:
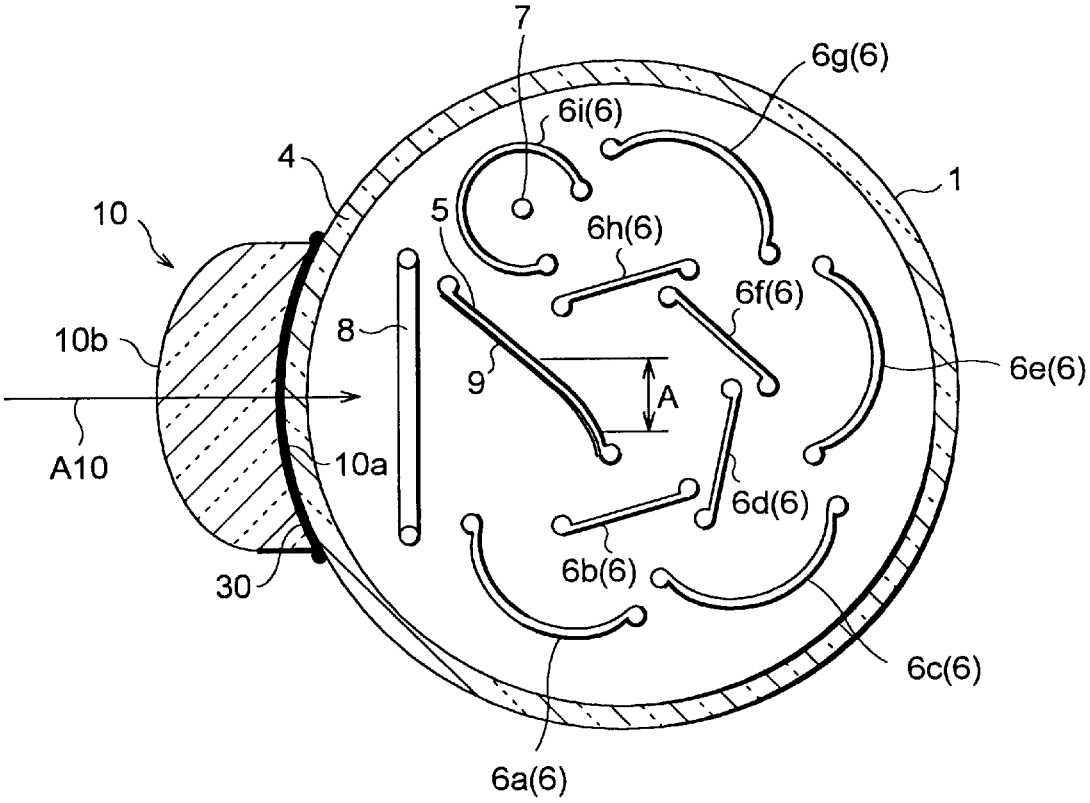
FIG. 3 is a sectional view of the first embodiment taken along line I—I in FIG. 1.

As shown in FIGS. 1 and 3, supported by a pair of the insulator substrates 2*a* and 2*b* therebetween are a reflection type photocathode 9. The refelection type photocathode 9 is supported by an electrode plate 5 and is inclined in the direction incident to the light to be detected (collimated light) as indicated by depicted arrow A10. An electron multiplier 6 comprises a plurality of stages of dynodes 6*a* to 6*i* for cascade-multiplying a photoelectron emitted from the photocathode 9 and an anode 7 for collecting the multiplied electrons (secondary electrons) as output signals. Further disposed between a light incident region 4 on the outer peripheral surface of the envelope 1 and the photocathode 9 is a grid electrode 8 for securely guiding the photoelectrons emitted from the photocathode 9 into the dynode 6*a* of the first stage. This grid electrode 8 is set to the same potential as the photocathode 9. Also, the photocathode 9 is formed on the electrode plate 5 and faces the light incident region 4 of the envelope 1.

Also, in this embodiment, a cylindrical lens 10, as a condenser lens, is secured to the light incident region 4 on the outer peripheral surface (convex surface) of the envelope 1 with an adhesive 30 disposed therebetween. This cylindrical lens 10 is made of a material (transparent to the light to be detected) identical to that of the envelope 1, while having a bonding surface 10*a* with a radius of curvature substantially identical to that of the outer peripheral surface of the envelope 1 and a cylindrically-curved light entrance surface 10*b* with a radius of curvature smaller than that of the bonding surface 10*a*. Accordingly, when the bonding surface 10*a* of the cylindrical lens 10 coated with the adhesive 30 of epoxy resin type (e.g., product No. 1565 manufactured by Cemedine Co., Ltd.) is pressed against the light incident region 4 of the envelope 1, the cylindrical lens 10 can securely be bonded to the outer peripheral surface of the envelope 1 (see FIG. 5). Here, either the whole surface or only marginal portions of the bonding surface 10*a* of the cylindrical lens 10 may be coated with the adhesive 30. The condenser lens may also be a plastic cylindrical lens 50 shown in FIG. 2 obtained by injection molding. This cylindrical lens 50 has side surfaces 51 and 52 formed by cutting both sides of the cylindrical lens 50.

Figure 4:
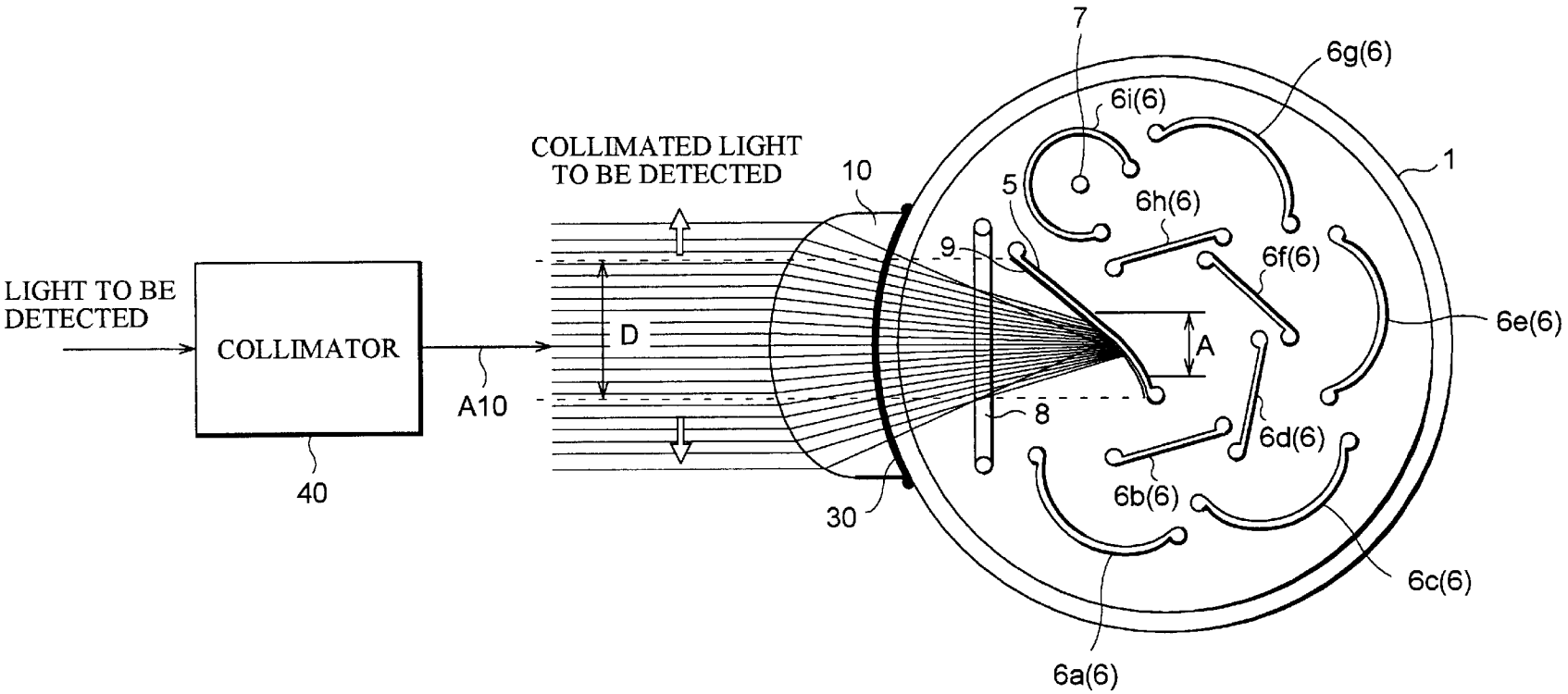
FIG. 4 is a view for explaining a function of the lens element (restricting member) employed in the photomultiplier and light detecting apparatus according to the present invention, which corresponds to the sectional view of the first embodiment taken along line I—I in FIG. 1.

Further, the radius of curvature of the light entrance surface 10*b* of the cylindrical lens 10 is selected such that, as shown in FIG. 4, the light incident on the cylindrical lens 10 substantially forms a focal point in an effective region A of the photocathode 9. When the cylindrical lens 10 is utilized, the light to be detected can be collected into a slit form on the effective region A of the photocathode 9. Thus, the form of collected light on the photocathode 9 is elongated in its longitudinal direction so as to match the long form of the photocathode 9. Accordingly, when the part generating photoelectrons is formed like a long slit, the long electron multiplying region produced by each of the dynodes 6*a* to 6*i* can effectively be utilized. Also, the condenser lens can guide a part of collimated light, which cannot reach the photocathode 9 by itself, to the effective region A. It indicates that an incident region D of the light to be detected is enlarged, thereby the photomultiplier can sufficiently be applied to such a use as measurement of weak light.

Figure 5:
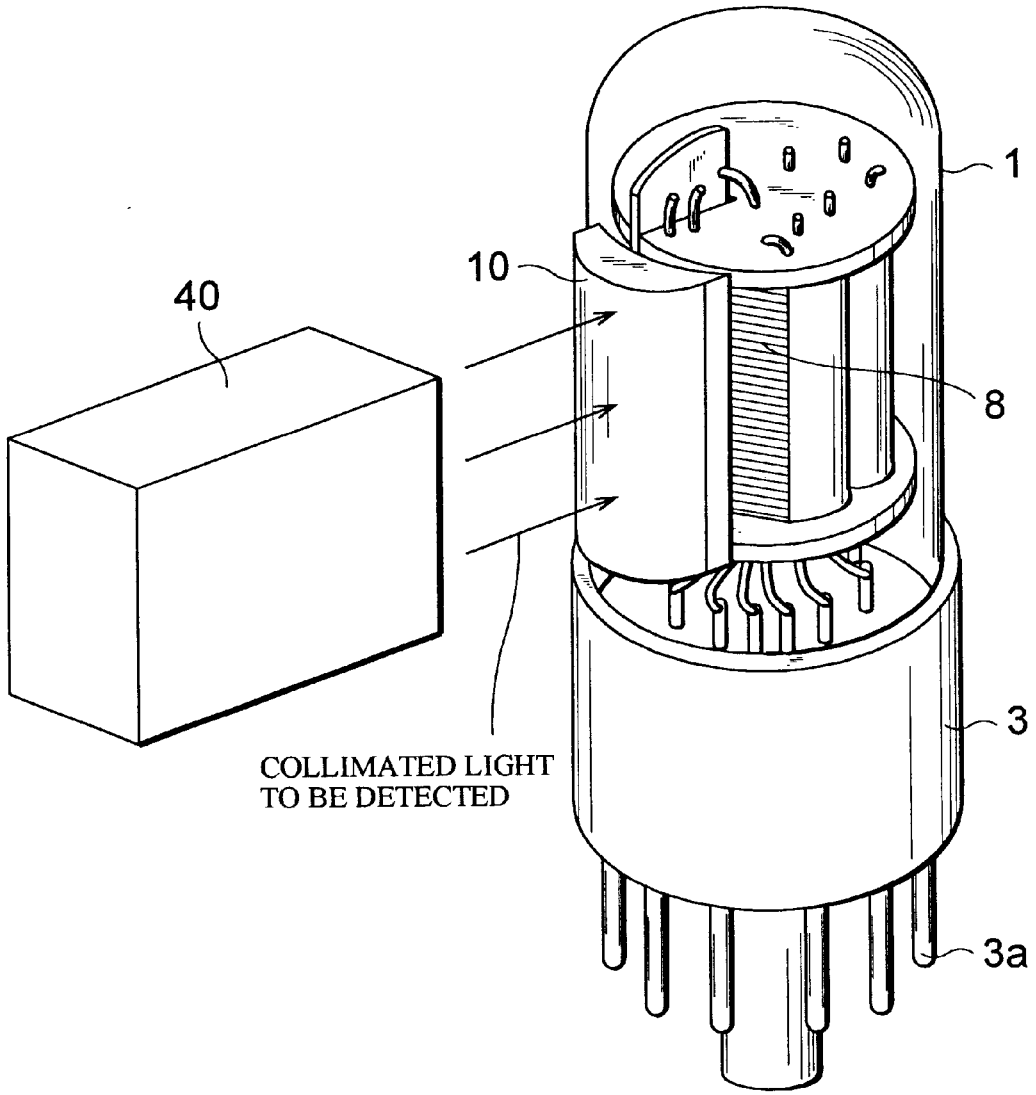
FIG. 5 is a perspective view showing the first embodiment of the side-on type photomultiplier according to the present invention and a light detecting apparatus to which the first embodiment is applied.

As shown in FIG. 5, a light detecting apparatus to which the side-on type photomultiplier according to the present invention is applied comprises a collimator 40 for collimating the light to be detected in order to sufficiently obtain the above-mentioned function of the condenser lens.

Figure 6:
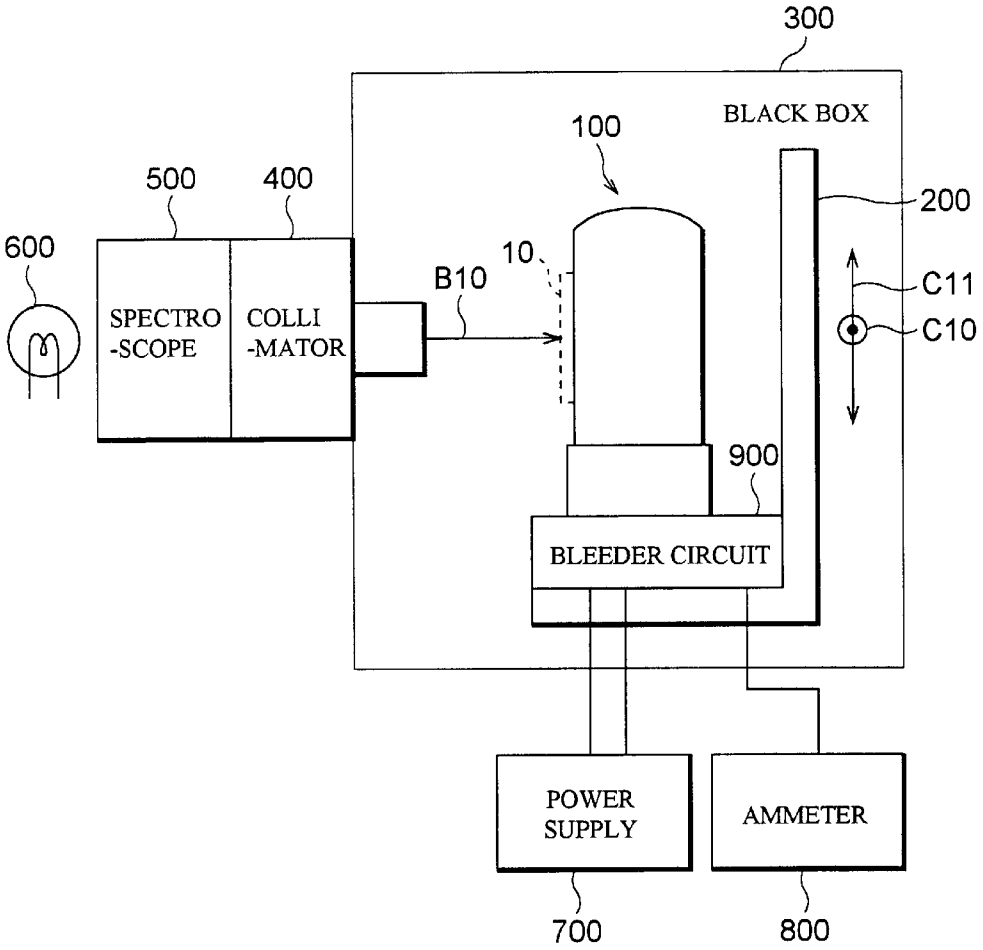
FIG. 6 is a measurement system for measuring a sensitivity characteristic of the side-on type photomultiplier according to the present invention.

FIG. 6 is view showing a measurement system for measuring the uniformity in light receiving sensitivity of a side-on type photomultiplier which is an object to be measured.

The measurement system shown in FIG. 6 comprises, at least, a light source 600 a spectroscope 500; a collimator 400; a black box 300; and a stage 200. The spectroscope 500 selects a light component with a predetermined wavelength from the light emitted from the light source 600. The collimator 400 collimates the light component selected by the spectroscope 500. The black box 300 accommodates a photomultiplier 100 (including photomultipliers with and without the lens element 10) which is the object to be measured. The stage 200 relatively moves the object to be measured with respect to a beam B10 emitted from the collimator 400. The power supply 700 supplies a desired voltage to the object to be measured. The bleeder circuit 900 divides the voltage supplied from the power supply 700. The an ammeter 800 detects the output signals obtained from the anode of the object to be measured 100.

Here, the stage 200 on which the object to be measured 100 is mounted and the bleeder circuit 900 are accommodated in the black box 300. The stage 200 moves the object to be measured 100 in the directions indicated by depicted arrows C10 (directions perpendicular to the paper surface) and in the directions indicated by depicted arrows C11 (directions orthogonal to the directions indicated by C10).

Figure 7:
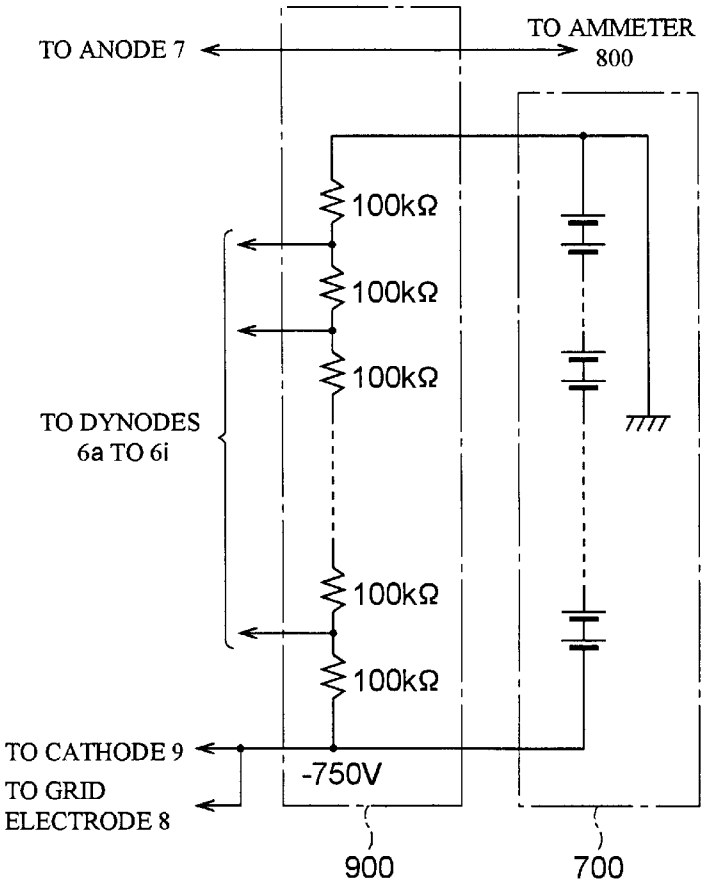
FIG. 7 is a view showing a configuration of a bleeder circuit and power supply in the measurement system of FIG. 6.

As shown in FIG. 7, the bleeder circuit 900 comprises a plurality of resistors connected in series, thereby dividing the voltage supplied from the power supply 700.

Here, the above-mentioned effective region A is, in the whole surface of the photocathode 9, not only an area which has a high sensitivity but also an area where stray electrons are hard to occur. This effective region A is an area which is near the dynode 6*a* of the first stage, is positioned near the center axis side of the envelope 1, and is far from the grid electrode 8 having the same potential. Namely, as can also be seen from FIGS. 2 and 3, the effective region A refers to, in the photocathode 9, an area which extends from near the center portion toward the dynode 6*a* of the first stage and where the light receiving sensitivity (anode output) in the width directions (directions indicated by arrows C10 in FIG. 6) is not lower than 80%. Here, there are also cases where the effective area A is determined as an area in which the light receiving sensitivity in the width directions (C10) is not lower than 90%.

Because the place for generating each photoelectron is restricted to a narrow area referred to as the effective region A, there is little deviation among times at which individual photoelectrons are generated. Also, because the photoelectrons are generated at places close to each other, fluctuation in electron transit time can be made very small. Further, even when the position of the light source fluctuates to a certain extent, thereby somewhat changing the position of light incident on the condenser lens, because the light is collected at the effective region A for photoelectrons, in combination with little fluctuation in electron transit time, the output from the anode fluctuates slightly. Moreover, even when the positioning of the photocathode with respect to the object to be measured is not precisely effected, light can be collected at an appropriate position of the photocathode 9 due to the condensing action of the condenser lens, thereby facilitating the optical axis alignment of the object to be measured with the photocathode 9. Thus, a small shift in the optical axis hardly affects the uniformity in light receiving sensitivity. Such a condensing action is effective, in particular, for weak light such as chemiluminescence, bioluminescence, or fluorescence, thereby contributing to improvement in S/N. Besides, since the condenser lens is firmly bonded to the outer peripheral surface of the envelope in the side-on type photomultiplier of the present invention, operations for making a product are easy to effect, and the yield of the product is quite favorable. Also, when the form or bonding position of the condenser lens is appropriately changed in response to the output sensitivity characteristic of the photomultiplier before the mounting of the lens, a product can easily be made in conformity with a need.

Next, the inventors measured changes in light receiving sensitivity between photomultipliers with and without a condenser lens by using the measurement system shown in FIGS. 6 and 7.

Specifically, the wavelength of the light to be detected was 400 nm, whereas its spot diameter was 1 mm. The condenser lens used was a cylindrical lens having a width of 15 mm (in the directions indicated by C10 in FIG. 6) and a length of 26 mm (in the directions indicated by C11 in FIG. 6). Here, the radius of curvature of the light entrance surface 10*b* was designed such that the collimated light to be detected could reach into the effective region A.

The scanning pitch of the spot light (having a wavelength of 400 nm and a spot diameter of 1 mm) in the width directions C10 was 1 mm. On the other hand, the scanning pitch of the spot light (having a wavelength of 400 nm and a spot diameter of 1 mm) in the length directions C11 was also 1 mm. By connecting a plurality of 100-kΩ resistors in series, the bleeder circuit 900 equally divided the applied voltage. An output terminal of the anode 7 is electrically connected to the ammeter 800, whereas a voltage of −750 V was applied to the photocathode 9 and the grid electrode 8.

Figure 8:
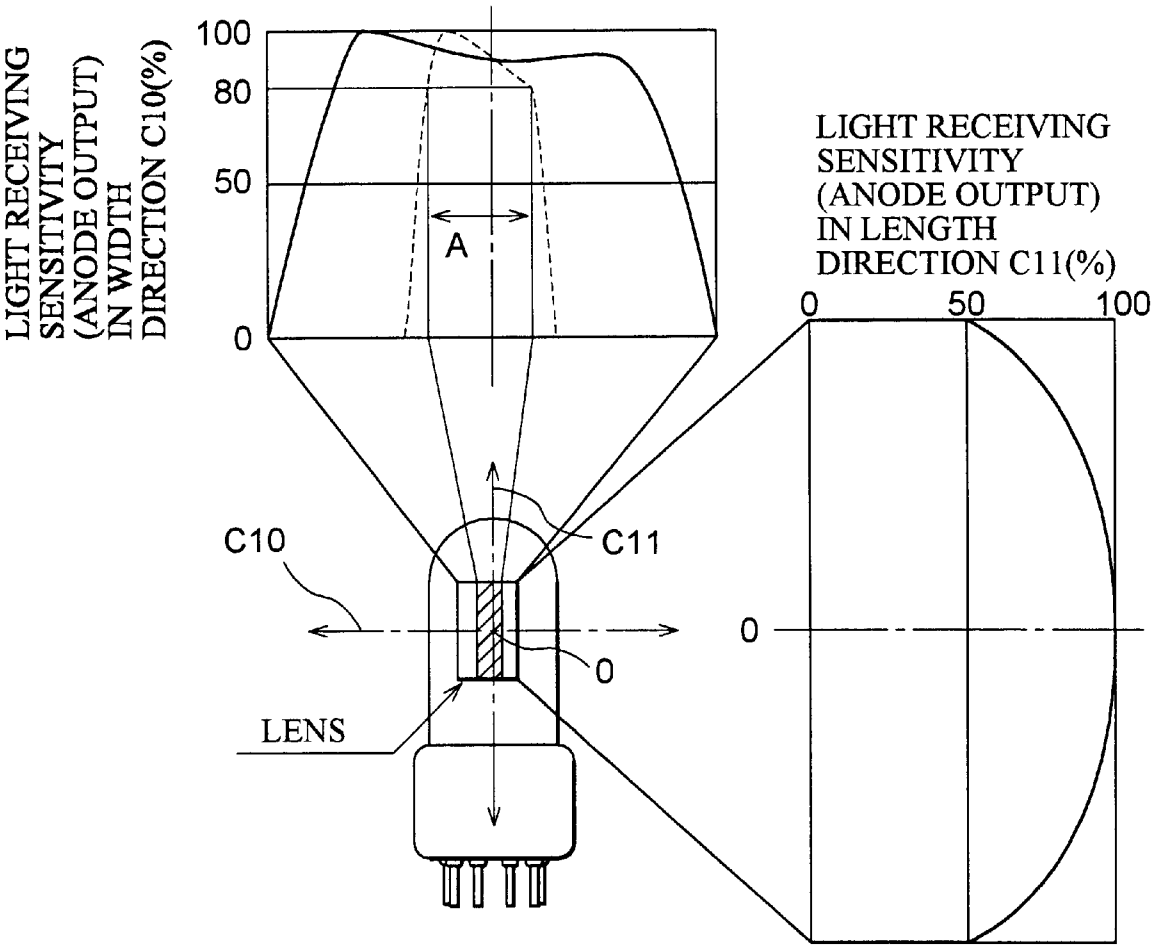
FIG. 8 is a graph showing respective anode outputs of side-on type photomultipliers with and without a lens element (restricting member) measured by the measurement system shown in FIG. 6.

FIG. 8 includes graphs each showing a relationship between the incident position of the spot light (with a spot diameter of 1 mm) and the anode output measured under the condition mentioned above. In these graphs, solid and dashed lines respectively indicate measured results of the photomultipliers with and without the condenser lens.

As can be seen from the upper-side graph in FIG. 8, the photomultiplier without the condenser lens can hardly measure the light to be detected incident on the outside of the effective region A. In the photomultiplier with the condenser lens, by contrast, a wide range of the light to be measured is guided by the condenser lens along the width directions C10 into the effective region A, thereby improving the uniformity in light receiving sensitivity.

Here, as can be seen from the right-side graph in FIG. 8, due to the forms of the photocathode 9 and dynodes 6*a* to 6*i*, no remarkable difference could be found in the light receiving sensitivity along the length directions C11 between the cases with and without the condenser lens.

Figure 9:
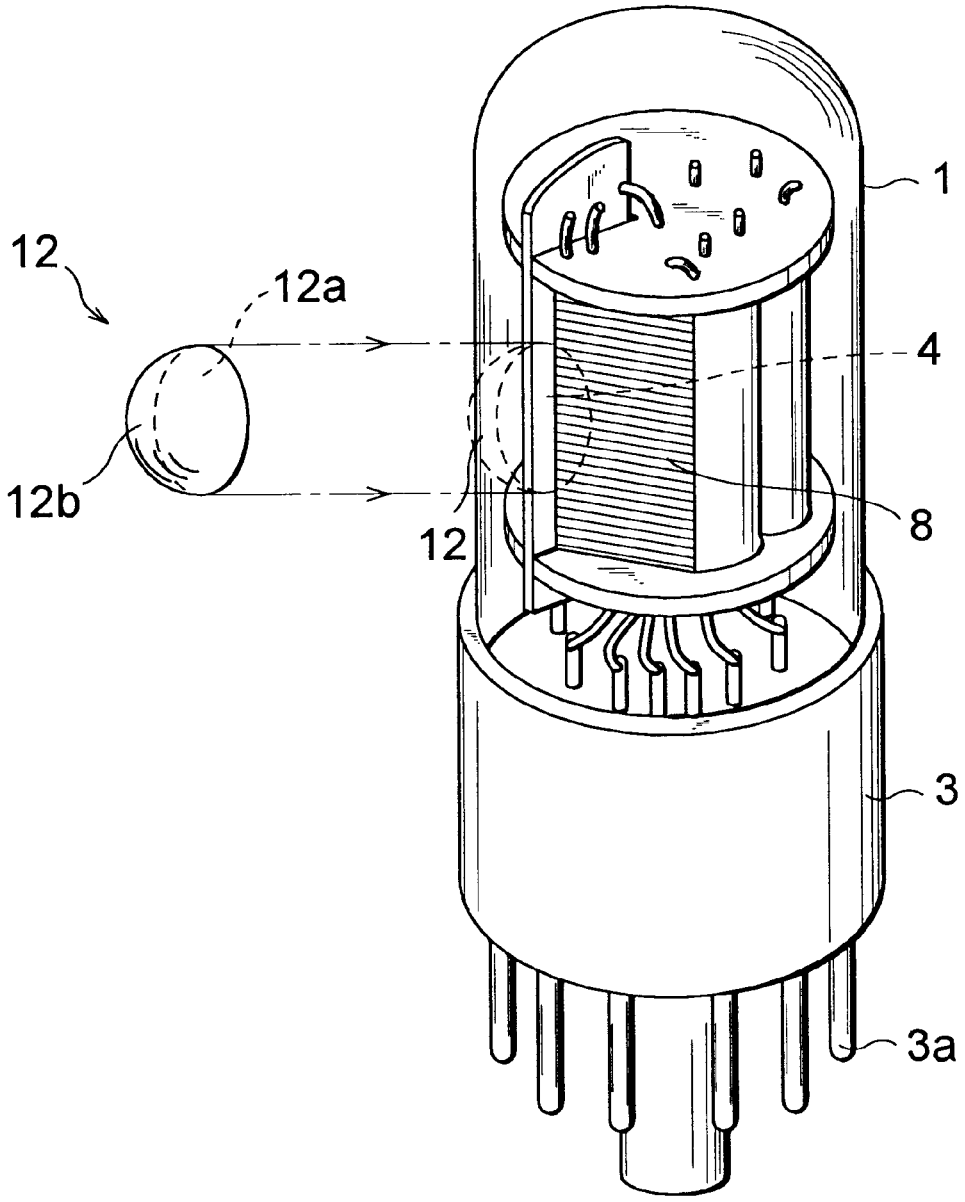
FIG. 9 is a perspective view for explaining an arrangement of a second embodiment of the side-on type photomultiplier in accordance with the present invention.

The present invention should not be restricted to the first embodiment mentioned above. For example, the condenser lens may be a hemispherical lens. FIG. 9 is a perspective view showing an arrangement of a second embodiment of the side-on type photomultiplier (to which a hemispherical lens 12 is applied) according to the present invention. In the second embodiment, the hemispherical lens 12 is made of a material identical to that of the envelope 1 and comprises a bonding surface 12*a* matching the shape of the outer peripheral surface of the envelope 1 (i.e., having a radius of curvature substantially identical to that of the outer peripheral surface) and a spherically-curved light entrance surface 12*b* with a radius of curvature smaller than that of the bonding surface 12*a*. Accordingly, when the bonding surface 12*a* of the spherical lens 12 coated with an epoxy resin type adhesive is pressed against the light incident region 4 on the outer peripheral surface of the envelope 1, the hemispherical lens 12 can securely be bonded to the outer peripheral surface of the envelope 1. Here, either the whole surface or only marginal portions of the bonding surface 12*a* of the hemispherical lens 12 may be coated with the adhesive.

Further, the radius of curvature of the light entrance surface 12*b* of the hemispherical lens 12 is selected such that the light incident on the hemispherical lens 12 substantially forms a focal point in the effective region A of the photocathode 9. Also, when the hemispherical lens 12 is utilized, the collimated light to be detected can be collected into a spot-like form on the effective region A of the photocathode 9. Selected as the location of this spot-like collected light portion is the center part on the effective region A where the light receiving sensitivity (anode output) in the length directions C11 is particularly high (see FIG. 8). When the light is thus substantially collected like a point, very weak light to be measured can securely be detected.

Of course, the envelope 1 and the condenser lenses 10 and 12 may be made of materials such as plastics (see FIG. 2) which are different from each other. Also, the bonding surfaces 10*a* and 12*a* of the condenser lenses 10 and 12 may be flat surfaces in conformity with the shape of the outer peripheral surface of the envelope 1. Of course, the adhesive is not restricted to the epoxy resin type.

As explained in the foregoing, in accordance with the present invention, a condenser lens is firmly bonded to the outer peripheral surface of the envelope. This condenser lens is disposed at a position where the incident light can be condensed onto, of the photocathode, the effective region having a high sensitivity, thereby a side-on type photomultiplier with a high versatility and a high uniformity in light receiving sensitivity can be realized. Also, after the electron multiplier is installed within the envelope, the condenser lens can firmly be bonded to the sealed envelope as a separate member. Further, worthy of special mention in the photomultiplier integrated with a lens according to the present invention are effects that uniformity in light receiving sensitivity is remarkably improved by a very simple amelioration in which a condenser lens is firmly bonded to a conventional side-on type photomultiplier.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The basic Japanese Application No. 237022/1996 filed on Sep. 6, 1996 is hereby incorporated by reference.

What is claimed is:

1. A side-on type photomultiplier comprising:

an envelope made of a material transparent to light to be detected;

a photocathode for emitting photoelectrons in response to said light to be detected reaching said photocathode after being transmitted through said envelope, said photocathode having a light receiving surface with a predetermined area, said photocathode being accommodated in said envelope and supported by an electrode member so as to be inclined with respect to a direction of incidence of said light to be detected;

a restricting member for limiting an area of a light incident region on said photocathode, where said light to be detected is to reach, so as to make the area of said light incident region smaller than the area of said light receiving surface of said photocathode, said restricting member being positioned outside said envelope; and an adhesive, provided between said restricting member and an outer peripheral surface of said envelope, for securing said restricting member onto said outer peripheral surface of said envelope, said adhesive being transparent to said light to be detected.

2. A side-on type photomultiplier according to claim 1, wherein said restricting member includes a lens element having a positive refracting power, said lens element having a bonding surface substantially corresponding to a shape of said outer peripheral surface of said envelope.

3. A side-on type photomultiplier according to claim 2, wherein said lens element includes a cylindrical lens having said bonding surface on a side facing said outer peripheral surface of said envelope.

4. A side-on type photomultiplier according to claim 2, wherein said lens element includes a hemispherical lens having said bonding surface on a side facing said outer peripheral surface of said envelope.

5. A light detecting apparatus comprising:

a side-on type photomultiplier according to claim 1; and a collimator for collimating light to be detected which is to be made incident on said side-on type photomultiplier.

* * * * *